US006329496B1

(12) United States Patent
Komaki et al.

(10) Patent No.: US 6,329,496 B1
(45) Date of Patent: Dec. 11, 2001

(54) METHOD FOR PROCESSING CHLORINE-CONTAINING ORGANIC COMPOUNDS

(75) Inventors: Ikuo Komaki, Futtsu; Hiroshi Uematsu, Tokyo; Kenji Kato, Futtsu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/744,631

(22) PCT Filed: Jul. 28, 1999

(86) PCT No.: PCT/JP99/04052

§ 371 Date: Jan. 26, 2001

§ 102(e) Date: Jan. 26, 2001

(87) PCT Pub. No.: WO00/06668

PCT Pub. Date: Feb. 10, 2000

(30) Foreign Application Priority Data

Jul. 29, 1998 (JP) ..... 10-213817
Jun. 25, 1999 (JP) ..... 11-179899

(51) Int. Cl.[7] ..... C08F 6/00
(52) U.S. Cl. ..... 528/480
(58) Field of Search ..... 528/480

(56) References Cited

FOREIGN PATENT DOCUMENTS 35 31 514 4/1987 (DE) .
40 12 397 2/1992 (DE) .
49-10321 3/1974 (JP) .
51-33493 9/1976 (JP) .
59-120682 7/1984 (JP) .
4-41588 2/1992 (JP) .
6-228565 8/1994 (JP) .
7-216361 8/1995 (JP) .
8-157834 6/1996 (JP) .
8-259955 10/1996 (JP) .
9-132782 5/1997 (JP) .
9-137926 5/1997 (JP) .
9-157834 6/1997 (JP) .
9-170009 6/1997 (JP) .
9-178130 7/1997 (JP) .
9-202907 8/1997 (JP) .
2765535 4/1998 (JP) .
10-281437 10/1998 (JP) .

*Primary Examiner*—Terressa M. Boykin
(74) *Attorney, Agent, or Firm*—Kenyon & Kenyon

(57) ABSTRACT

A method for processing chlorine-containing resins and chlorine-containing organic compounds includes thermally decomposing chlorine-containing resins, chlorine-containing organic compounds, or waste plastics containing the same, contacting the generated thermal decomposition gas containing chlorine-type gases and a gas or liquid containing ammonia, taking the chlorine component of the thermal decomposition gas into water as ammonium chloride, and further adding a strong base to make the chlorine component into a strong basic salt.

10 Claims, 9 Drawing Sheets

METHOD FOR PROCESSING CHLORINE-CONTAINING ORGANIC COMPOUNDS

TECHNICAL FIELD OF THE INVENTION

In recent years, so-called chlorine-containing resins such as polyvinyl chloride and polyvinylidene chloride, so-called chlorine-containing organic compounds such as polychlorinated biphenyls, and, further, resins such as polypropylene, polyethylene and polystyrene (the so-called 3Ps) are being annually discarded as industrial waste at the rate of about 4 million tons and as nonindustrial waste collected from households at the rate of about 4 million tons. These chlorine-containing resins, chlorine-containing organic compounds and other resins discarded as industrial waste and nonindustrial waste will hereinafter be called "waste plastics" for short.

The present invention relates to a processing method for recycling such waste plastics, particularly to a processing method recycling of chlorine-containing resins, chlorine-containing organic compounds or waste plastics containing these (chlorine-containing waste plastics) that is free of problems such as corrosion of processing equipment and degradation of product quality.

BACKGROUND ART

Most waste plastics have conventionally been disposed of by incineration and as landfill. Incineration involves damage to the incinerator owing to the large amount of heat generated, and, in the case of waste plastics containing chlorine, the issue of treating the chlorine in the exhaust gas. In addition, waste plastics are not decomposed by soil microorganisms or bacteria; there is a shortage of landfill sites and an environmental load has been stocked. In recent years, therefore, a call has arisen for adoption of environment-friendly recycling technologies to avoid incineration and landfill disposal. Current methods for recycling without incineration include methods for reuse as plastic raw material and for reuse of gas components and oil components obtained by thermal decomposition as fuel and chemical raw materials.

After being used as plastic products, polyvinyl chloride, polyvinylidene chloride and other chlorine-containing resins and the like are discarded along with other plastic products without being sorted out. Waste plastics therefore inevitably include a chlorine component carried in by chlorine-containing resins and the like. Sorted waste plastics recovered from households do in fact ordinarily contain polyvinyl chloride and polyvinylidene chloride, which, when calculated as chlorine, contain several wt % of chlorine. When thermally decomposed at high temperatures, polyvinyl chloride and other chlorine-containing resins generate chlorine-type gases such as hydrogen chloride gas and chlorine gas. When chlorine-containing resins or waste plastics containing them are processed for recycling at high temperature, therefore, the problem arises of the processing equipment and the like being corroded by the chlorine-type gases generated. Owing to this, conventional recycle-processing of waste plastics has been conducted by the method of, in advance, sorting out and removing chlorine-containing resins and other chlorine-containing waste plastics or removing only the chlorine component of the waste plastics and then reusing the gas components and oil components obtained by thermally decomposing the waste plastics as chemical raw materials and fuel.

Conventional methods known for recycle-processing waste plastics include, for example, the method of using a blast furnace, which is one process in iron- and steel-making, and utilizing waste plastics as an iron ore reducing agent (JP-B(examined published Japanese patent application)-51-33493). Various development efforts have recently been made in order to effectively implement this method (e.g., JP-A(unexamined published Japanese patent application)-9-170009, JP-A-9-137926, JP-A-9-178130, JP-A-9-202907, and Japanese Patent No. 2,765,535).

In the case of processing waste plastics with a blast furnace, decrease in blast furnace productivity and the effect of the chlorine component inevitably contained in the waste plastics must be taken into account.

Specifically, when the blast furnace is charged with an amount of waste plastics exceeding 10 kg per ton of pig iron produced, deactivation of the blast furnace core is induced to markedly degrade pig iron productivity. In the case of processing waste plastics with a blast furnace, therefore, the amount of waste plastics processed has conventionally been limited to 10 kg per ton of pig iron.

Moreover, waste plastics discarded as industrial waste and nonindustrial waste include so-called chlorine-containing resins, such as polyvinyl chloride and polyvinylidene chloride, and so-called chlorine-containing organic compounds such as polychlorinated biphenyls. Waste plastics, both industrial and nonindustrial, therefore on average include chlorine at about several wt % to several tens of wt % and, even after sorting, include chlorine at an average of several wt %. When waste plastics including such chlorine are charged into the blast furnace as they are, chlorine-type gases such as chlorine and hydrogen chloride are generated during thermal decomposition of the waste plastics, causing a problem of corrosion of the shell, stave coolers and the like of the blast furnace body and a problem of corrosion of furnace-top waste gas equipment and the furnace-top electrical equipment. In the case of processing waste plastics in the conventional blast furnace, therefore, there has been conducted pre-processing, such as in advance sorting out and removing chlorine-containing resins, chlorine-containing organic compounds and other chlorine-containing waste plastics or removing only the chlorine component of the waste plastics, and the waste plastics have been charged in the blast furnace after having their chlorine content reduced to 0.5 wt % or below.

Methods have also long been known for recycle-processing waste plastics by thermal decomposition using, instead of a blast furnace, a coke oven, which is one process in the same iron- and steel-making (JP-B-49-10321 and JP-A-59-120682). Recently, various development efforts have been made regarding methods for efficiently processing waste plastics, most notably waste plastic charging methods that take coke strength into account (e.g., JP-A-8-157834). In these cases, instead of coal, waste plastics, which are also hydrocarbons, are charged into the coke oven to obtain coke, tar, light oil and fuel gas by dry distillation. A coke oven can thus also be used as a waste plastic recycling facility.

However, in the case where a coke oven is used to process waste plastics, as in the case of processing in a blast furnace, it is necessary to give consideration to decrease in coke productivity caused by the charging of waste plastics, the effect on the equipment of the corrosion etc. by chlorine included in the waste plastics, and the effect on product quality.

Regarding product quality, when, for example, a blend of waste plastics and coal is charged into a coke oven, the amount of waste plastics charged into the coke oven is expected to be 10 kg per ton of coal, because the coke quality deteriorates sharply when the waste plastic charging amount exceeds 10 kg per ton of coal.

Regarding the effect of chlorine in the waste plastics, when waste plastics containing around several wt % of chlorine are charged into a coke oven as they are, a possibility exists of the chlorine component remaining in the coke after the waste plastics carbonize. Moreover, there is not only a danger that the chlorine-type gases produced by thermal decomposition of the waste plastics may mix into the tar, light oil and coke-oven gas that are byproducts at the time of coke production but also a danger that the generated chlorine-type gases will remain in the oven and/or corrode the oven body and the waste gas treatment system pipes. Conventionally, therefore, processes have bee effected for thermally decomposing only the chlorine component of the waste plastics before charging in the waste elastics in the coke oven, as taught by JP-A-7-216361, or for removing chlorine-system resins and other chlorine-containing waste plastics with a specific gravity separator or the like beforehand and charging the waste plastics into the coke oven after reducing their chlorine content to 0.5 wt % or below, as taught by JP-A-8-259955. Therefore, since the conventional methods of processing waste plastics using a coke oven actually involve complicated processing processes, no attempt has been made to put them to practical use.

As a method of recycle-processing waste plastics that does not use a blast furnace or a coke oven, there is the waste plastic processing method utilizing the gasification furnace proposed early by the present inventors in JP-A-10-281437.

However, this processing method is also yet to be implemented because the processing costs are high owing to the need for equipment for recovering the HCl gas and other chlorine-type gases generated.

In DE-40 12 397, a process is disclosed for the pyrolysis of chlorine containing waste material wherein ammonia is added to the halogen containing gases produced in a fluidization reactor in order to effect the precipitation of ammonium chloride/-halogenide after the gases have emerged from the heated parts of the reactor.

As pointed out in the foregoing, in conventional methods of recycle-processing waste plastics using a blast furnace or a coke oven, either of which is one process n the same iron- and steel-making, the problems of equipment corrosion and product quality degradation by chlorine-type gases generated from the waste plastics, which problems are encountered in either case, make it necessary that the charging into the blast furnace or the coke oven be done after first either sorting out and removing chlorine-containing resins, chlorine-containing organic compounds and other chlorine-containing waste plastics or removing only the chlorine component of the waste plastics. This has made the processing steps complicated and led to increased processing costs. Waste plastics that have been collected from throughout a city and subjected to magnetic sorting, aluminum sorting etc. ordinarily contain a chlorine component of approximate from 3 wt % to 5 wt %. This is because the collected waste plastics contain from 6 wt % to 10 wt % of chlorine-containing waste plastics, mainly polyvinyl chloride and the like. In the case of a blast furnace, it is generally accepted that a problem of corrosion by the chlorine-type gases in the blast furnace will arise unless the ordinary chlorine content is lowered to 0.5 wt % or below. Also in the case of a coke, owing to concern about corrosion of the oven body and the waste gas processing system and about the effect on product quality, the waste plastics is charged into the coke oven after first lowering the chlorine content thereof to 0.5 wt % or below.

As the method for lowering the chlorine content of the waste plastics to 0.5 wt % or below, there is adopted either the method, using a dechlorinator, of thermally decomposing the waste plastics by heating to around 300° C. and removing the chlorine component thereof as chlorine-type gases, or the method of separating the waste plastics into light plastics and heavy plastics by specific gravity separation using a centrifuge or the like and sorting out and selecting only the light plastics of low chlorine content. Of these methods, the former method using a dechlorinator is very complicated because it is applied to all of the collected waste plastics. In addition, it is extremely difficult technologically by this method to reduce the chlorine content of the waste plastics from 3–5 wt % to 0.5 wt %. The method is therefore seldom adopted. The later method of separating into light plastics and heavy plastics by specific gravity separation using a centrifuge or the like and sorting out and selecting only the light plastics of low chlorine content is rather more generally adopted. The specific gravity separation method, however, also involves problems such as the following. Explanation will be made taking the method of specific gravity separation using a centrifuge as an example. Generally, when, for example, 100 kg of waste plastics removed of extraneous matter (including 10 kg of vinyl chloride and having a chlorine weight of 5 kg) is separated with a centrifuge, ideal separation, i.e., separation into 90 kg with a chlorine content of 0% as light plastics and 10 kg with a chlorine content of 50% as heavy plastics (the chlorine content of polyvinyl chloride generally being 57%), is impossible. The separation is generally into 50 kg with a chlorine content of 0.5% as light plastics and 50 kg with a chlorine content of 9.5% as heavy component. Even if the conditions are further optimized, the limit is separation into 70 kg with a chlorine content of 0.5% as light plastics and 30 kg with a chlorine content of 15.5% as heavy plastics. In this case, as the waste plastics of a chlorine content of 9.5–15.5 wt % separated as heavy plastics (accounting for 30–50% of the waste plastics before specific gravity separation) are impossible to lower to a chlorine content of 0.5 wt % by further dechlorination, they can only be treated as a residual to be disposed of as, for instance, landfill.

Treating them as residual involves processing costs and, what is more, this treatment is essentially indicative of the low recycle rate of the waste plastic recycle-processing method and cannot be called a practical recycle-processing method that responds to social requirements.

SUMMARY OF THE INVENTION

The present invention, which is aimed at overcoming the foregoing technical problems, provides a processing method for recycling waste plastics that is capable of reducing or eliminating the load on the waste plastic dechlorination process heretofore considered indispensable in a processing method for recycling waste plastics containing 0.5 wt % or more of chlorine and that has no problem of equipment corrosion or problem of product quality degradation. The gist thereof is as set out below.

(1) A method for processing chlorine-containing resin, chlorine-containing organic compound, or waste plastic containing the same, characterized in thermally decomposing chlorine-containing resin, chlorine-containing organic compound or waste plastic containing the same, contacting generated thermal decomposition gas including chlorine-type gas with coal gas containing ammonia generated during dry distillation of coal, to take a chlorine component of the thermal decomposition gas into ammonia liquor as ammonium chloride, and adding a strong base to the ammonia liquor to make the chlorine component into a strong basic salt.

(2) A method for processing chlorine-containing resin, chlorine-containing organic compound, or waste plastic containing the same according to (1) above, characterized in that chlorine content of the chlorine-containing resin, chlorine-containing organic compound or waste plastic containing the same is not less than 0.5 wt %.

(3) A method for processing chlorine-containing resin, chlorine-containing organic compound, or waste plastic containing the same according to (1) or (2) above, characterized in that the strong base is sodium hydroxide and the strong basic salt is sodium chloride.

(4) A method for processing chlorine-containing resin, chlorine-containing organic compound, or waste plastic containing the same according to any of (1)–(3) above, characterized in that the chlorine-containing resin, chlorine-containing organic compound, or waste plastic containing the same is dry distilled in a coke oven.

(5) A method for processing chlorine-containing resin, chlorine-containing organic compound, or waste plastic containing the same according to any of (1)–(4) above, characterized in that the chlorine-containing resin, chlorine-containing organic compound, or waste plastic containing the same is dry distilled together with coal.

(6) A method for processing chlorine-containing resin, chlorine-containing organic compound, or waste plastic containing the same according to any of (1)–(3) above, characterized in that the chlorine-containing resin, chlorine-containing organic compound, or waste plastic containing the same is thermally decomposed in some coke oven chambers of a coke oven having multiple coke oven chambers, generated thermal decomposition gas including chlorine-type gas is contacted with ammonia liquor circulating through the coke oven, and chlorine component of the thermal decomposition gas is taken into the ammonia liquor as ammonium chloride.

(7) A method or processing chlorine-containing resin, chlorine-containing organic compound, or waste plastic containing the same according to (5) above, characterized in that the chlorine-containing resin, chlorine-containing organic compound, or waste plastic containing the same is blended with coal at a ratio of not less than 0.05 wt % and nor greater than 26 wt % of the coal and dry distilled for thermal decomposition.

(8) A method for processing chlorine-containing resin, chlorine-containing organic compound, or waste plastic containing the same according to (5) above characterized in that the chlorine-containing resin, chlorine-containing organic compound, or waste plastic containing the same is blended with coal at a ratio of not less than 0.05 wt % and not greater than 1 wt % of the coal and dry distilled to produce coke.

(9) A method for processing chlorine-containing resin, chlorine-containing organic compound, or waste plastic containing the same, according to any of (1) to (8) above, characterized in that chlorine-containing resin, chlorine-containing organic compound or waste plastic containing the same is thermally decomposed, ammonia generated during dry distillation of coal is used to take generated chlorine-type gas into ammonia liquor as ammonia chloride, and an amount of the coal used is that discharges ammonia at 1.1 to 2 times the molar amount of chlorine in the generated chlorine-type gas.

(10) A method for processing resin, chlorine-containing organic compound, or waste plastic containing the same according to any of (1)–(9) above, characterized in that the chlorine-containing resin, chlorine-containing organic compound or waste plastic containing the same is heated for volume-reduction and hardened before thermal decomposition.

BEST MODES FOR CARRYING OUT THE INVENTION

Figure 1:
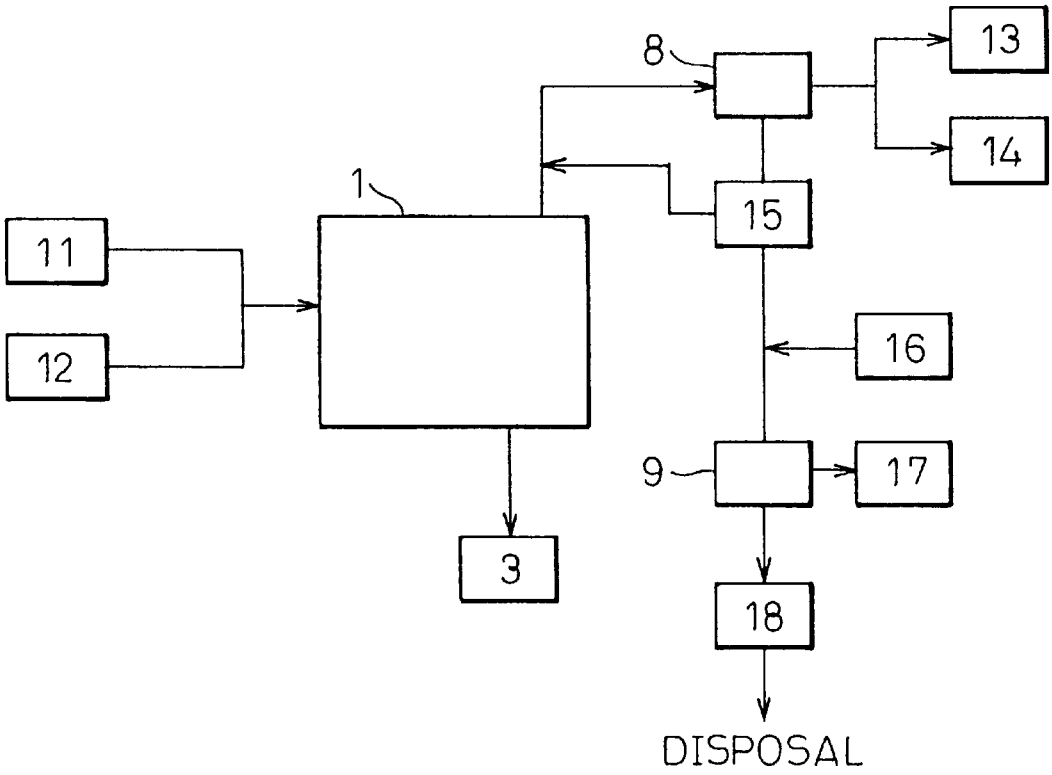
FIG. 1 is a flow diagram showing the present invention.

Coke-oven gas is generally generated when coal is dry distilled (carbonized) in the coke oven chambers of a coke oven. This gas includes a tar component, ammonia, water and so forth. After being discharged from the coke oven, this coke-oven gas is cooled by flushing with ammonia liquor (aqueous ammonia produced from the coal, stored and circulated as a coolant) and separated into coke-oven gas, tar, and ammonia liquor. The coke-oven gas is used as fuel gas and the ammonia liquor is circulated for use in flushing.

Focusing on the ammonia and flushing ammonia liquor produced in the process of dry distillating coal in the coke oven, the present inventors conducted the following detailed study regarding methods for using these to convert into ammonium chloride and other chlorides and make harmless the chlorine-type gases (chlorine-containing gases) that become a problem in recycle-processing of waste plastics containing 0.5 wt % or more chlorine.

The present inventors comminuted waste plastics containing chlorine-system resins to about 10 mm and volume-reduced them using a screw kneader. The volume-reduction temperature was about 120° C. owing to screw friction heating. The properties of the volume-reduced waste plastics are shown in Table 2 and Table 3. What was obtained by cutting these to a diameter of about 10 mm and air-cooling them on a conveyor belt was mixed in advance with coal at 1–2 wt % and charged into the coke oven chambers of a coke oven battery having 100 coke oven chambers. The coke oven measured 430 mm in width and 6.5 m in height. Charging into the coke oven was from the top of the coke oven by the same method as for conventional coal charging. The dry distillation pattern adopted was the same as that for conventional coke production. The total dry distillation time was 20 hr.

Coke-oven gas (hereinafter denoted as COG) generated during dry distillation contains ammonia and the COG is cooled by flushing ammonia liquor in the ascension pipes. The ammonia liquor was added with caustic soda in accordance with its ammonium chloride concentration to convert the ammonium chloride to sodium chloride and ammonia, whereafter the ammonia was vaporized and removed in an ammonia remover. By this operation, the chlorine-type gases that becomes a problem in recycle-processing of waste plastics containing 0.5 wt % or more of chlorine were made harmless as ammonium chloride and other chlorides.

The present inventors used the following method to investigate the percentage of chlorine input to the coke oven that distributed to the products. Chlorine-containing waste plastics containing from 2.00 wt % to 2.32 wt % of chlorine were blended with coal at a blending rate of 1–2 wt % and the blend was dry distilled in a coke oven. The coke, ammonia liquor and COG were sampled and the chlorine concentration of each product was measured. The measurement of chlorine concentration was done by using ion chromatography to measure the Cl ion quantity of the chlorides obtained in accordance with the Testing Method for Cl by the Bomb Combustion Method of JIS K 2541 "Testing Method for Sulfur Component of Petroleum and Petroleum Products" and converting to total Cl amount.

Table 1 shows chlorine concentration of the products when chlorine-containing waste plastics containing 2.00 wt % of chlorine were blended with coal at a blending rate of 1 wt % and the blend was dry distilled in a coke oven.

TABLE 1

| | Coal only | | Added with 1% waste plastics | |
|---|---|---|---|---|
| Product | Distribution (%) | Chlorine concentration (ppm) | Distribution (%) | Chlorine concentration (ppm) |
| Gas | 11 | 25 | 12 | 25 |
| Ammonia liquor | 12 | 1200 | 12 | 2700 |
| Tar | 3 | 330 | 3 | 340 |
| Kerosine | 1 | 3 | 1 | 3 |
| Coke | 73 | 400 | 72 | 402 |

The present inventors further blended the waste plastics A (chlorine content: 2.32%) and the waste plastics B (chlorine content: 2.19%), whose compositions are shown in Table 2 and Table 3, with coal at a blending rate of 1–2 wt %, dry distilled the blend in a coke oven, and measured the chlorine concentration of the products at this time. Since different types of coal were used in the respective tests for coal only and tests for coal added with waste plastics in Tables 1–3, the volatile components, alkali metals alkaline earth metals, and the like of the raw material coals differ somewhat.

Figure 4:
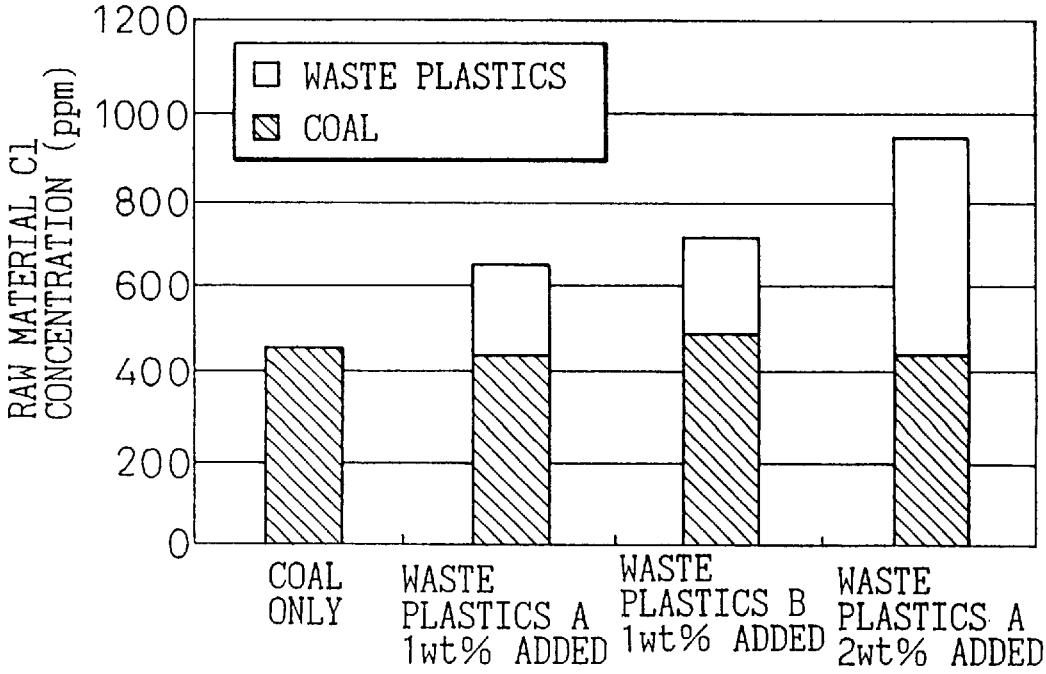
FIG. 4 is a diagram showing the chlorine concentrations of coke oven charge materials when waste plastics were added.
Figure 5:
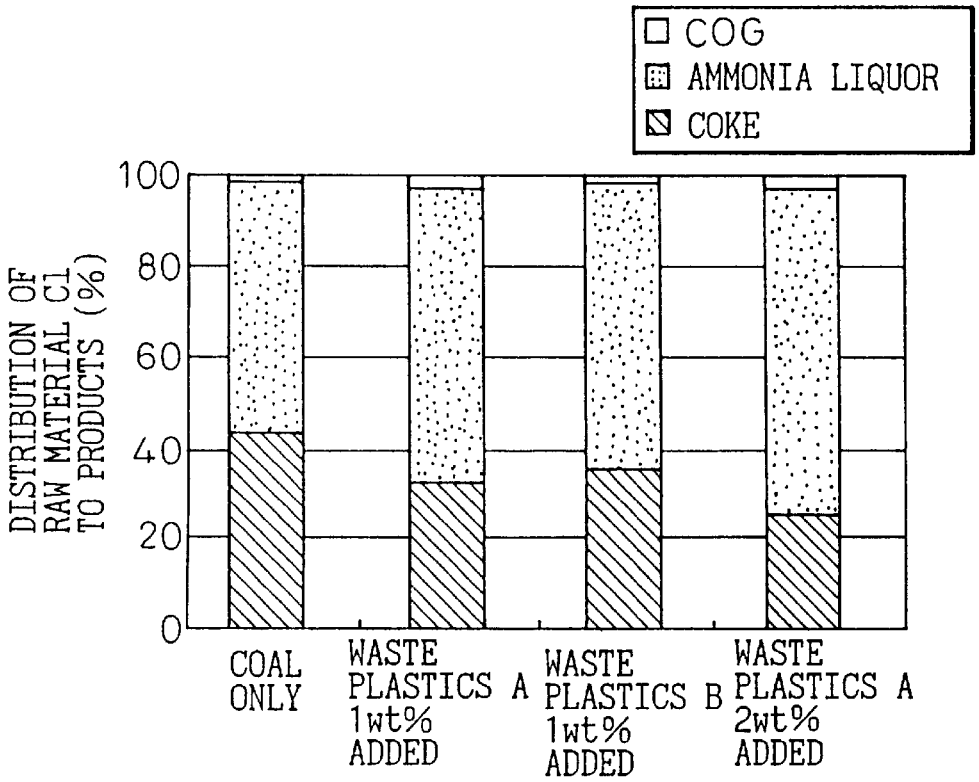
FIG. 5 is a diagram showing the distribution of chlorine in the raw material to the products when waste plastics were added.
Figure 6:
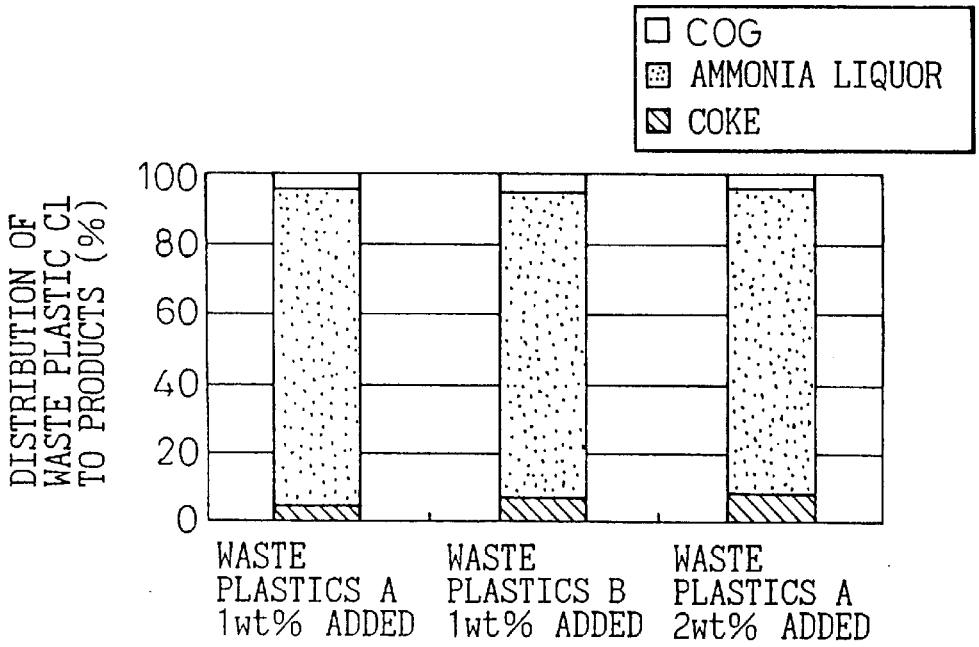
FIG. 6 is a diagram showing the distribution of chlorine in the waste plastics to the products.

The chlorine concentrations of the coals added with waste plastics at the respective rates are shown in FIG. 4. The coals containing these waste plastics were dry distilled in a coke oven and the chlorine concentration of the products were investigated. The results are shown in FIG. 5. The distribution ratio of chlorine from the waste plastics to the products was investigated. As shown in FIG. 6, the results were 89% to ammonia liquor, 7% to coke and 4% to COG.

TABLE 2

| | Elemental analysis (wt %) | | | | | Ash |
|---|---|---|---|---|---|---|
| | C | H | N | S | Cl | (wt %) |
| Waste plastics A | 69.8 | 9.1 | 0.6 | 0.22 | 2.32 | 6.26 |
| Waste plastics B | 72.6 | 9.2 | 0.3 | 0.04 | 2.19 | 5.03 |

TABLE 3

| | (wt %) | | | | | | | |
|---|---|---|---|---|---|---|---|---|
| | PE | PS | PP | PVC | PVCD | PET | Low molecular compounds | Insoluble component |
| Waste plastics A | 21.4 | 24.8 | 13.7 | 5.2 | 0.4 | 15.5 | 6.3 | 12.7 |
| Waste plastics B | 15.4 | 7.5 | 15.0 | 4.7 | 0 | 29.8 | 5.7 | 21.8 |

The foregoing results clarified that while addition of chlorine-system waste plastics of chlorine-system waste plastics to coal increases the chlorine concentration of the raw material, the residue rate in the coke is low and the chlorine concentration of the coke does not increase. Moreover, from the fact that almost no increase occurs in the chlorine concentration of the COG and the fact that the chlorine concentration of the ammonia liquor increases, it was clarified that the chlorine-type gas does not remain in the coke oven chambers, meaning there is no concern of its leaking out during coke force-out, but is captured by the ammonia liquor.

Figure 7:
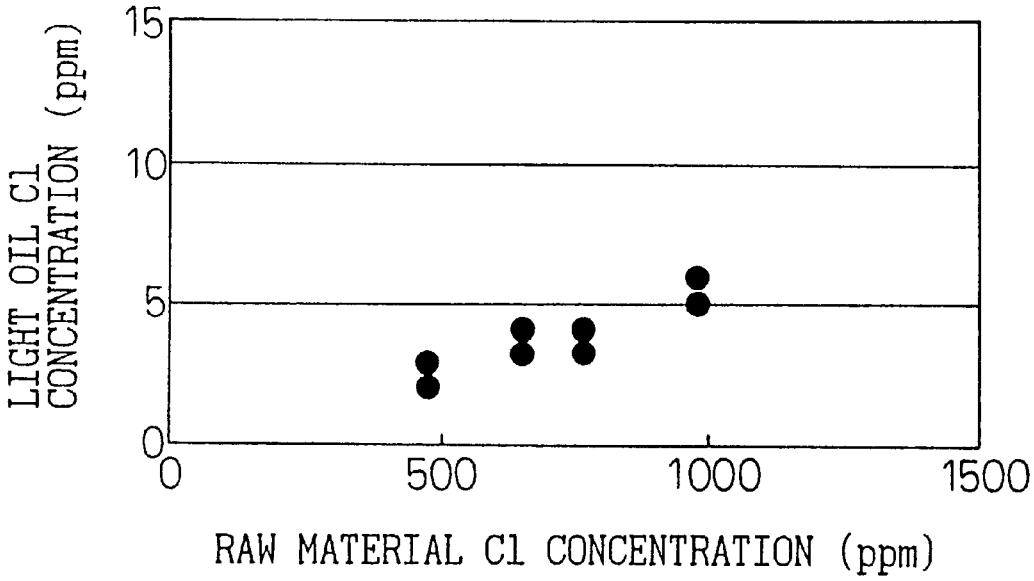
FIG. 7 is a diagram showing relationship between chlorine concentration in waste plastics and chlorine concentration in light oil.
Figure 8:
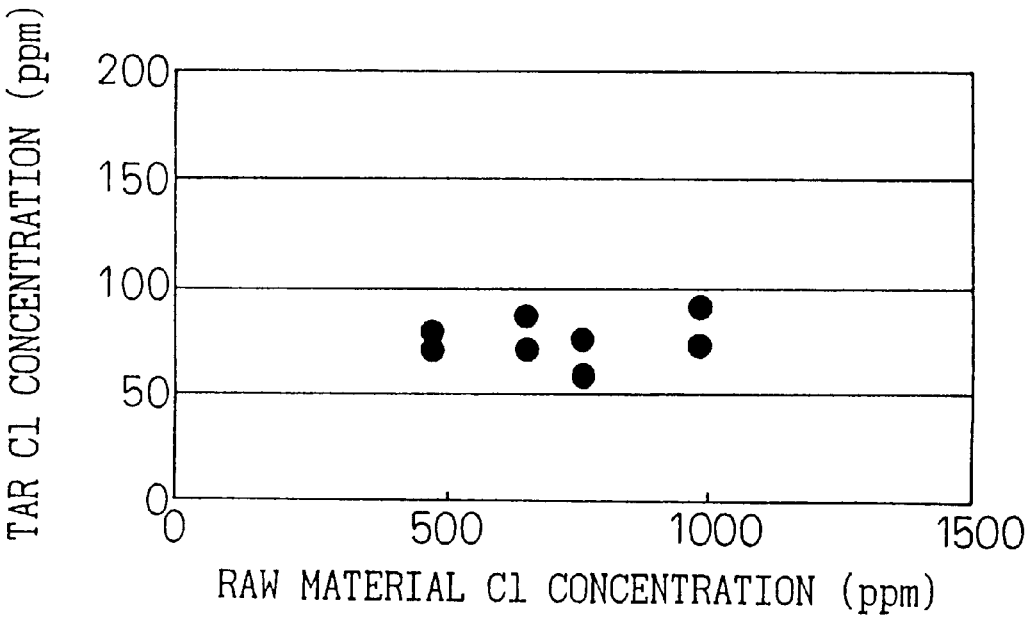
FIG. 8 is a diagram showing relationship between chlorine concentration in waste plastics and chlorine concentration in tar.

The present inventors investigated the effect on byproducts. As a result, as shown in FIGS. 7 and 8, it was ascertained that the chlorine concentrations of the light oil and the tar did not exceed the upper operational limits, i.e., that there was no problem.

Figure 9:
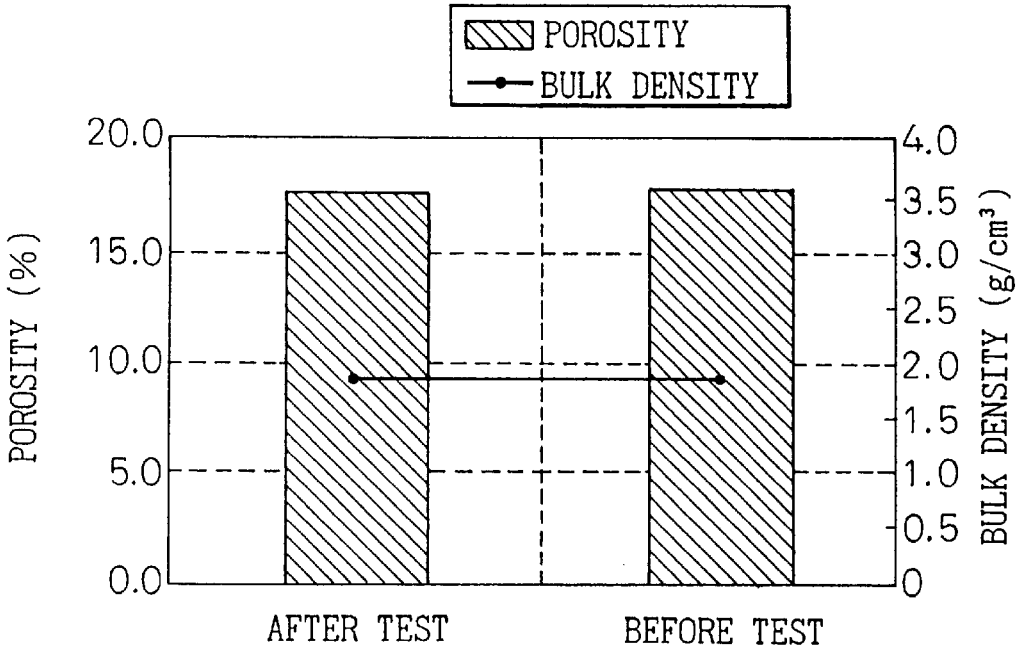
FIG. 9 is a diagram showing a comparison of the porosity and the bulk density of silica brick before and after testing.

The present inventors investigated effect on the silica brick of the coke oven by analyzing the porosity and bulk density of silica brick before and after two-month tests using waste plastics A and B. As a result, as shown in FIG. 9, it was ascertained that the porosity and bulk density of the silica brick did not change even though chlorine-system waste plastics were charged into the coke oven. Moreover, from the fact that EMPA analysis conducted on silica brick before and after the tests did not detect chlorides from the silica brick it was ascertained that conducting operation with chlorine-system waste plastics added to the raw material does not cause a problem regarding the silica brick of the coke oven.

To investigate the effect on the dry main (collecting main), an auxiliary facility of the coke oven, the present inventors conducted a corrosion resistance test by suspending test pieces of SUS (stainless steel) and SS (mild steel) materials in the dry main over a two-month test period. No change was observed in the appearance of the test pieces between before and after the test, while from the fact that, as shown in Table 4, the weight of the test pieces did not change between before and after the test, it was ascertained that the dry main (collecting main) is not affected by addition of chlorine-system waste plastics to the raw material coal.

TABLE 4

| Test piece no. | Weight before test (g) | Weight after test (g) | Weight change (g) |
|---|---|---|---|
| No. 1 | 50.7826 | 50.7818 | −0.0008 |
| No. 2 | 51.3165 | 51.3168 | +0.0003 |
| No. 3 | 51.3160 | 51.3178 | +0.0018 |
| No. 4 | 51.2785 | 51.2786 | +0.0001 |
| No. 5 | 50.7171 | 50.7199 | +0.0028 |
| No. 6 | 50.9614 | 50.9596 | −0.0018 |
| No. 7 | 51.6130 | 51.6190 | +0.0060 |

Specifically, as a result of repeatedly conducting various tests and diligent studies regarding processing for recycling waste plastics containing 0.5 wt % more chlorine by use of a coke oven, the present inventors obtained the following knowledge.

1) When chlorine-containing waste plastics is dry distilled in the coke oven chamber of a conventional coke oven, the chlorine-containing resins and organic compounds decompose at 250–1300° C. and the possibility of the chlorine component remaining in the coke is a concern. However, it was ascertained that when chlorine-containing waste plastics are dry distilled together with coal, 90% or more of the chlorine component moves to the gas phase after waste plastic decomposition and the amount remaining in the coke as residual is not more than 10%.
2) Conventionally, if chlorine-type gases remained in the coke oven chamber, there was a possibility of it leaking out at the time of coke force-out. The present inventors ascertained, however, that chlorine-type gases moving to the gas phase rise within the coke oven chambers of the coke oven to the oven-top space above the charged coal and under the 1100° C. atmosphere at the time of force-out and scarcely remain in the oven through dry distillation so that no problem arises even if the oven cover is left open during force-out.
3) As the chlorine-type gases generated after thermal decomposition of chlorine-containing plastics are corrosive gases, the problem of corrosion of the waste gas system pipes has been a concern up to now. Tests showed, however, that if the generated chlorine-type gases are mixed with the ammonia-containing coke-oven gas, thereafter led to the bend section of the ascension pipes of the coke oven and cooled to around 80° C. by flushing with ammonia liquor (aqueous ammonia produced from the coal, stored and circulated as a coolant), it becomes possible to capture most of the chlorine-type gases contained in such gases and to remove the chlorine component from the coke-oven gas.
4) In the case of blending chlorine-containing waste plastics whose chlorine content is 0.5 wt % or higher with coal and dry distillating the blend, there has conventionally been a concern about the chlorine-type gases generated by thermal decomposition of the waste plastics being transferred to the byproducts. It was ascertained, however, that no problem occurs because the chlorine concentrations of the tar and light oil, the byproducts, do not exceed their upper operational limits during distillation.
5) In the case of blending chlorine-containing waste plastics whose chlorine content is 0.5 wt % or higher with coal and dry distillating the blend, there has conventionally been a concern about the adverse effect of chlorine on the silica brick of the coke oven wall, the dry main and the like. It was determined, however, that these problems do not arise.

As explained in the foregoing, it was found through test-based studies that when the hydrogen chloride and other chlorine-type gases generated by thermal decomposition of chlorine-containing waste plastics in a coke oven are subjected to ammonia liquor flushing at the coke oven ascension pipe sections, about 90% thereof is captured in the ammonia liquor. This is thought to be because the ammonia liquor flushing causes the chlorine-type gases to react efficiently with the coal-derivative ammonia in the ammonia liquor and thus to be dissolved in the ammonia liquor in the form of ammonium chloride, thereby efficiently separating them from the coke-oven gas.

During the ammonia liquor flushing, the tar-containing, high-temperature coke-oven gas is cooled, whereby the tar is entained into the ammonia liquor. The tar in the ammonia liquor is separated for use as a byproduct by decantation. The ammonia liquor removed of the tar component is at the first stage stored in a tank, whereafter the ammonia liquor is discharged from the system at the rate of 100–200 kg per ton of coke and the remainder of the ammonia liquor is reused for flushing in the coke oven.

When the chlorine-type gases generated from the chlorine-containing waste plastics are captured in the ammonia liquor as ammonium chloride by ammonia liquor flushing, the ammonium chloride accumulates in the ammonia liquor because, as just mentioned, most of the ammonia liquor is recirculated. The possibility of its eventually exceeding its solubility therefore becomes a concern. As explained in the following, however, tests showed that no problem arises.

Specifically, the flushing with ammonia liquor does cause the chlorine-type gases generated from the coal raw material and the waste plastics during dry distillation to remain in the ammonia liquor as ammonium chloride but water is simultaneously discharged during dry distillation at the rate of 100–200 kg (about 5550 mol–11000 mol) per ton of coke. This is derived from the water contained in coal at about 9% and the water generated in the other reactions at about 3%.

Assume, for instance, that 160 kg of water is discharged in the process of producing 1 ton of coke. Since the solubility of ammonium chloride is 37.2 g per 100 g water at 20° C. and the atomic weight of ammonium chloride is 53.4, a calculation shows that the amount of ammonium chloride dissolvable per ton of coke is about 1100 mol [=(160000×0.372)/53.4]. In the case of effecting dry distillation with chlorine-containing waste plastics added to coal raw material at the rate of 1 wt % (10 kg) per ton, therefore, the calculated amount of chlorine generated comes to about 80 mol (80 mol as HCl, 40 mol as $Cl_2$), even assuming the waste plastics to be composed of 50% polyvinyl chloride. The amount of water generated in the case of coal dry distillation is therefore sufficient to dissolve the chlorine generated from the chlorine-containing plastics in water as ammonium chloride.

Saturation of the ammonia liquor used for flushing with ammonium chloride is therefore not a concern in the case of processing chlorine-containing plastics in a coke oven.

The present inventors next conducted a study regarding processing of the ammonium chloride in the ammonia liquor after the chlorine-type gases generated by the waste plastics are captured as ammonium chloride by ammonia liquor flushing.

It is a conventional practice to take a portion of the ammonia liquor generated during dry distillation of coal in a coke oven out of the system, subject the ammonia liquor to heating or vapor stripping in an ammonia removing equipment to remove free ammonia by vaporization, and discharge it after effecting activated sludge treatment. In order to prevent the discharged ammonium chloride from heightening the nitrogen concentration of seawater, the practice has been, particularly in cases where the concentration of the ammonium chloride in the ammonia liquor is high, to subject the ammonia liquor to a pretreatment for freeing ammonia by adding caustic soda to the ammonia liquor before the aforesaid removal of free ammonia by vaporization.

In order to compare and study differences in behavior between the chlorine component in the coal and the chlorine component in the waste plastics in the course of dry distillation, the present inventors went beyond the chlorine-containing waste plastic dry distillation test described earlier to conduct the following test and analysis regarding the behavior of the chlorine component during dry distillation of coal only.

The coke, ammonia liquor and COG obtained by dry distillating coal charged into a coke oven were sampled and the Cl concentration of each was investigated. The coke oven measured 430 mm in width and 6.5 m in height. The total coal dry distillation time was 20 hr. The measurement of chlorine concentration of the coal, coke and COG was done by using ion chromatography to measure the Cl ion quantity of the chlorides obtained in accordance with the Testing Method for Cl by the Bomb Combustion Method of JIS K 2541 "Testing Method for Sulfur Component of Petroleum and Petroleum Products" and converting to total Cl amount. The measurement of the chlorine concentration of the ammonia liquor was done by using ion chromatography to measure the Cl ion quantity and converting to total Cl amount.

As shown in FIG. 5, the inventors ascertained by the foregoing dry distillation test that when coal was dry distilled alone, 45% of the chlorine component of the coal is transferred to the coke, 54% to the ammonia liquor and 1% to the COG.

On the other hand, as was explained earlier regarding the results of the test charging chlorine-containing waste plastics, the chlorine component in the waste plastics was distributed at the rate of about 7% of to the coke, 89% to the ammonia liquor and about 4% to the COG (FIG. 6). Compared with coal, the rate of chlorine component residue in the coke was low and almost all of the chlorine component migrated to the ammonia liquor and the COG.

The reason that the chlorine component of waste plastics has a lower rate of residue in the coke than that in the case of coal is thought to be because most of the chlorine in coal is inorganic chlorine which decomposes during dry distillation but remains in the coke by forming stable alkaline earth metals chlorides at high temperature, while the chlorine in the waste plastics is organic chlorine that readily undergoes thermal decomposition and is transferred almost entirely to the gas phase.

Based on this knowledge regarding the chlorine behavior during dry distillation of chlorine-containing waste plastics, a further study was made regarding nitrogen concentration at the time of partial discharge of the ammonia liquor as a waste water.

The chlorine content of coal, although differing among different types of coal, is several hundred ppm. As just pointed out, when the coal is dry distilled, about half of the chlorine is transferred to the gas phase, reacts with ammonia generated during coal dry distillation, and is captured in the form of ammonium chloride in the water generated by dry distillation of the coal. In this case, the nitrogen concentration of the effluent is such that nitrogen is present in the effluent produced by the coke oven at the rate of between 800 mg and 1000 mg per liter.

When chlorine-containing waste plastics having a chlorine content of 0.5 wt % are added to coal at the rate of 1 wt % per ton and dry distilled, then, assuming in line with the foregoing finding that about 90% of the chlorine-type gases generated from the waste plastics move to the gas phase, it follows that the nitrogen content of the effluent will increase by 150 mg to 185 mg per liter relative to the case of not charging waste plastics.

This increase in the nitrogen content of the effluent at the time of dry distillating chlorine-containing waste plastics having a chlorine content of 0.5 wt % cannot be ignored from the point of heightening the nitrogen concentration of seawater.

The present inventors at this point discovered that in the case of recycle-processing chlorine-containing waste plastics having a chlorine content of 0.5 wt % in a coke oven it is necessary to convert ammonium chloride to free ammonia by adding a strong base such as caustic soda to the effluent. Specifically, if sodium hydroxide, for instance, is added to the ammonia liquor, the ammonium chloride in the ammonia liquor is converted to harmless sodium chloride and ammonia, whereafter the nitrogen component of the ammonia liquor is removed by vaporization of the ammonia in an ammonia remover.

Based on this knowledge, the present inventors conducted the following concrete experiment in which chlorine-containing waste plastics were dry distilled together with coal and the ammonium chloride in the ammonia liquor was converted to free ammonia by addition of caustic soda.

Figure 10:
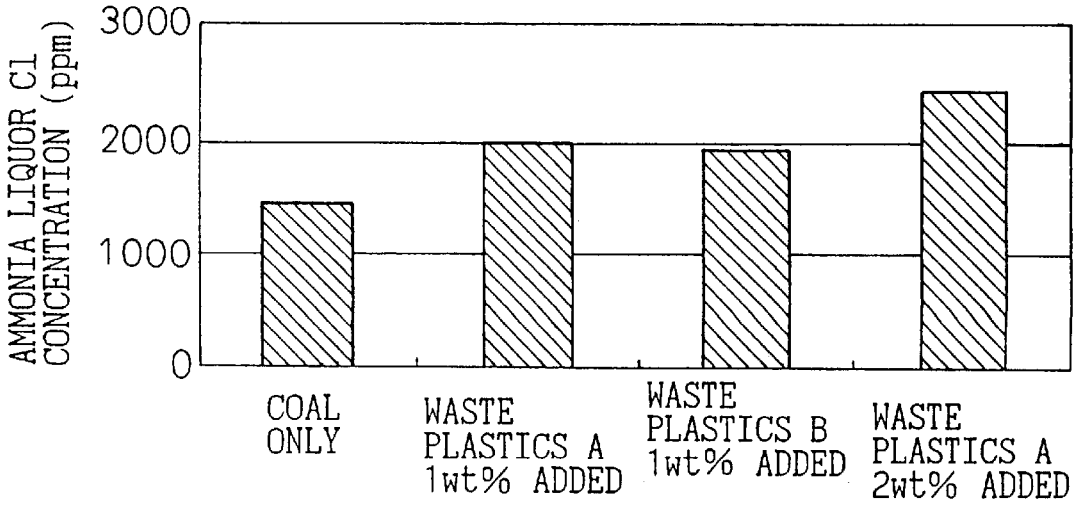
FIG. 10 is a diagram showing chlorine concentration of ammonia liquor when waste plastics containing chlorine were added to coal.
Figure 11:
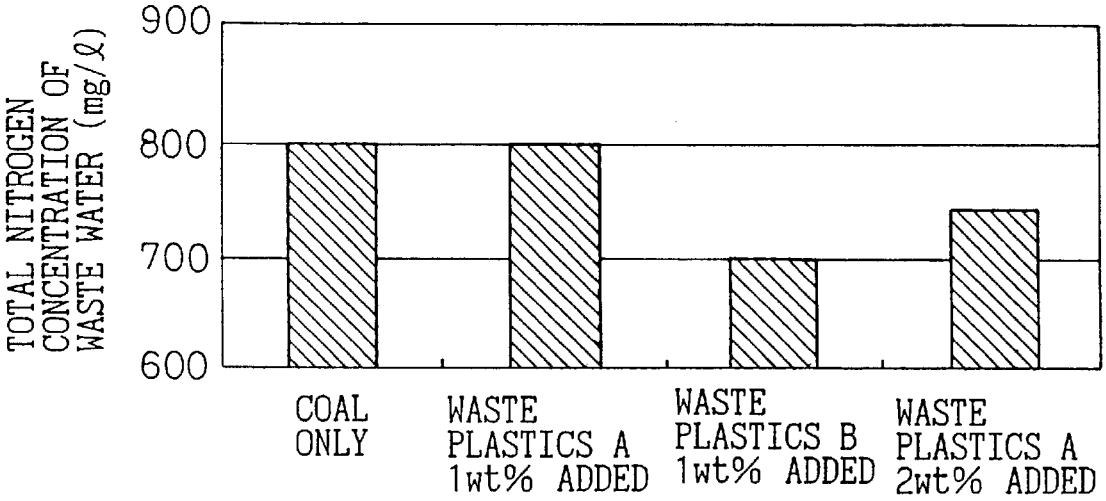
FIG. 11 is a diagram showing total nitrogen concentration of ammonia liquor after ammonia removal when waste plastics containing chlorine were added to coal.

Waste plastics A (chlorine content, 2.32 wt %) and waste plastics B (chlorine content, 2.19 wt %) were separately blended with coal at 1–2 wt %, charged into a coke oven and dry distilled, and the obtained ammonia liquor was added with caustic soda to free fixed ammonia. As shown in FIG. 10, the chlorine concentration of the ammonia liquor increased owing to the blending of waste plastics containing chlorine with the coal. As shown in FIG. 11, however, it was found that addition of caustic soda to the ammonia liquor enabled the total nitrogen content to be maintained at the same level as when only coal was dry distilled even in the cases where coal added with 1–2 wt % of waste plastics containing 2.19–2.32 wt % of chlorine was dry distilled in the coke oven.

By the foregoing experimental results, it was ascertained that in the case of dry distillating chlorine-containing waste plastics in a coke oven, about 90% of the chlorine-type gases generated by thermal decomposition move to the ammonia liquor and that by adding caustic soda (sodium hydroxide) to the result to convert sodium chloride to ammonia and then vaporizing and removing the ammonia in an ammonia remover, seawater nitrogen concentration can be prevented.

Thus, as set out in the foregoing, through diligent studies regarding the method of dry distillating in a coke oven as a method for processing waste plastics containing chlorine, the present inventors discovered 1) that even if chlorine-containing waste plastics are dry distilled together with coal at 250° C.–1300° C. in a coke oven, substantially all of the chlorine in the waste plastics is transferred to the gas phase and does not remain in the coke, 2) that the chlorine-type gases that move to the gas phase move from inside the oven to the ascension pipe side during about 20 hours of dry distillation so that no chlorine-type gases remain in the oven at the time of coke force-out, 3) that most of the chlorine-type gases that move to the gas phase are captured in the ammonia liquor as ammonium chloride by ammonia liquor flushing, 4) that even if the ammonia liquor is recirculated for use, the flushing ammonia liquor does not saturate with ammonium chloride because it is added with water generated during coal dry distillation, 5) that the chlorine concentrations of the tar and light oil obtained as byproducts during dry distillation of blended chlorine-containing waste plastics and coal do not cause a problem because they do not exceed their upper operational limits during distillation, 5) that in the case of blending chlorine-containing waste plastics and coal and dry distillating the blend, the coke oven wall silica brick, the dry main and the like are unaffected, and 7) that heightening of the nitrogen concentration of seawater can be prevented by adding caustic soda or other strong base to the ammonia liquor to make the chlorine component finally harmless.

Moreover, the processing by this method is extremely simple compared with the conventional method of dechlorination of the waste plastics beforehand because it does not require a special dechlorination processing facility or step. In the case where plastics having a chlorine content of 3–5 wt % are dechlorinated beforehand to a level that does not affect the equipment, i.e., to a chlorine content of 0.5 wt % or below, outlays for dechlorination processing equipment and other new facilities are necessary. With the method for processing waste plastics using a coke oven according to the present invention, however, waste plastics can be effectively recycled by addition of simple equipment for adding the caustic soda needed to make the ammonium chloride in the ammonia liquor after flushing harmless.

By a coke oven test, it was ascertained that in the present invention when ordinary dry distillation and coking are implemented with the coal added with 1–2 wt % of chlorine-containing waste plastics having a chlorine content of about 2.3 wt %, the dry distillation yield of the waste plastics is about 40% of tar/light oil, about 20% of coke and about 40% of COG. Specifically, most of the waste plastics thermally decomposed in the coke oven become hydrogen, methane, ethane, propane and other high-calorie reduction-decomposed gases that are contained in the coke-oven gas. When recovered, they can be reused as by products like tar and light oil and as energy sources such as fuel gas. Moreover, the remaining carbon component becomes a part of the coke to be reused in a blast furnace. The waste plastics can thus be effectively recycled.

The present invention will now be explained in detail.

Waste plastics discarded as industrial waste are collected from the respective discarding industries separately as ones that, by material property, contain and do not contain chlorine-system plastics and extraneous matter. Regarding size and shape, the waste plastics can be assembled in lots in accordance with the capability of the receiving facility. The waste plastics hauled to the processing facility can be processed beforehand into a condition convenient for charging into a processing facility such as a coke oven or a thermal decomposition furnace. They are, for example, made into pelletized material for a coke oven or thermal decomposition furnace by crushing—extraneous matter removal—and fine chopping (to under around 10 mm).

Plastics discarded as nonindustrial waste consist plastic rubbish, incombustible rubbish etc. sorted and discarded from households. These are initially collected by local communities. Those assembled in lots at the local community stockyards are transported to the pertinent processing facility by a company contracted to recycle plastic rubbish. In this case, although collection into lots classified by plastic material or extraneous material is impossible, the composition of average sorted plastics is 75% of combustibles consisting mainly of plastics (including 5–10% of chlorine components), 5% of magnetic metals, 2% of aluminum, 8% of glass and other inorganic components (including 5% inorganic components in combustible components), and 10% of water. When these waste plastics of the nonindustrial waste type are to be charged into a coke oven, thermal decomposition furnace or other such processing facility, they must be sorted beforehand for removal of metals constituting extraneous materials. The collected waste plastics are subjected to tearing of plastic bags—magnetic sorting—extraneous material removal (of nonmagnetic material). Moreover, waste plastics of the nonindustrial waste type are collected as films, foamed bodies and powders, so that the charge material obtained by merely comminuting them to a prescribed particle size would have a small bulk density and a large bulk. As it would also contain excessive powder, it might sometimes be difficult to charge. Moreover, plastic with a small bulk density and a large bulk is very troublesome to handle since it is liable to ignite in the vicinity of a high-temperature coke oven or thermal decomposition furnace. In advance, therefore, the chlorine-containing plastics are heated to a temperature of 80° C.–190° C., compressed in this state and then recooled, thereby effecting volume-reduction and hardening. After passing through these operations, the nonindustrial waste plastic obtains a condition convenient for charging in a coke oven or a thermal decomposition furnace, e.g., has an ash content of not more than 10%, a chlorine component of not greater than 3.0%, a particle size of 10–70 mm, a lower calorific value of not less than 5000 Kcal/kg, and heavy metal of not greater than 1%.

Regarding the size of the volume-reduced and hardened material, the design can be made appropriately in light of transportability and, in the case of adopting a coke oven, mixability with coal, coke strength when dry distilled together with coal, danger of ignition and the like. Generally, however, around 5–10 mm is appropriate. For the volume-reduction and hardening method, there can be adopted a conventionally used resin kneader, drum-type heater or the like.

As regards the furnace used in the present invention to thermally decompose the chlorine-containing plastics, there can be adopted a furnace having a furnace wall structure that can be heated to 600° C. and higher, that possesses corrosion resistance against chlorine-type gases, e.g., one having a refractory wall constituted of silica brick, chamotte brick or the like, and it suffices to equip this furnace with a unit for dissolving the ammonia of the generated gas in water and flushing the waste gas therewith. Specifically, it can be a coke oven (FIG. 2) or, otherwise, a dedicated thermal decomposition furnace provided alongside a coke oven. In the case of a dedicated thermal decomposition furnace installed alongside a coke oven, the thermal decomposition gas generated by the thermal decomposition furnace can be led to the ascension pipes of the coke oven and ammonia liquor be used to incorporate chlorine-type gases into the ammonia liquor as ammonium chloride.

An embodiment of the present invention will now be explained with reference to FIGS. 1 and 2.

When waste plastics 11 and coal 12 are dry distilled in a coke oven chamber 1 of a coke oven, the generated hydrogen chloride gas and ammonia gas pass through an oven-top space 4 above the charged material in the coke oven chamber 2 and then through an ascension pipe 5 provided above the coke oven chamber to a bend pipe 6. The gas temperature is around 800° C. at the oven-top space 4 and about 700° C. at the ascension pipe section.

The material of the ascension pipes is generally cast iron. Although the chlorine-type gases were not observed to produce corrosion between the ascension pipes and the collecting main in the inventors' studies, from the point of long-term corrosion resistance the design should preferably take into account corrosion of the pipe material up to the dry main, where ammonia gas is water-sprayed (flushing). Also regarding the shield plates and knife edges of the coke oven, although in the inventors' studies no particular problem was observed concerning corrosivity even when ordinary materials were used, in consideration of long-term corrosion resistance the material should preferably be changed as required, e.g. to two-phase stainless steel or incoloy.

Methods usable for charging the waste plastics into the coke oven or the thermal decomposition furnace installed alongside include the method of making additions at the oven- or top space of the coke chamber (e.g., JP-A-9-157834), the method of making additions at the bottom of the coke oven chambers (e.g., JP-A-9-132782), and the method of charging after premixing with coal (e.g., JP-A-6-228565). When waste plastics are to be concentratedly charged into only specified coke oven chambers, the preferable method is to effect gas-stream conveyance to the oven-top space using an inert gas and then to use a storage hopper with fixed amount dispensing capability to dump the waste plastics into the specified coke oven chambers together with the inert gas. Further, in order to avoid the problems of thermal decomposition gas blowout and atmospheric air intake, charging of the waste plastics is preferable conducted in a state sealed off from the atmosphere. Specifically, there can be adopted the method of charging into the space above the coke oven chambers taught in the applicant's JP-A-4-41588.

When waste plastics are processed in a coke oven, some of the multiple coke oven chambers can be used as dedicated chambers for recycle-processing of waste plastics. Specifically, this is a method of designating several chambers of a coke oven composed of more than 100 coke oven chambers exclusively for heat treatment of waste plastics, using circulated ammonia liquor to flush both the chlorine-type gases generated by thermal decomposition in these and the coke-oven gas, capturing the chlorine-type gases in the coke-oven gas in the ammonia liquor as ammonium chloride, and then adding a strong base to free ammonia and make the chlorine component harmless. This method can be carried out with equipment that is capable of using an aqueous ammonium solution like the flushing ammonia liquor of a coke oven in common at all coke oven chambers. This method uses some of the coke oven chambers as dedicated chambers for thermal decomposition of chlorine-containing plastics and, therefore, unlike in the case of dry distillating chlorine-containing plastics and coal together in the same coke oven chamber, it imposes no limit from the point of coke quality degradation on the amount of waste plastics charged and enables the temperature of the dedicated coke oven chambers to be appropriately set within a broad range extending from 400–1300° C.

Moreover, in this case chlorine-containing waste plastics can be processed in an amount chemically equivalent to the ammonia generated by the coal and, therefore, chlorine-containing waste plastics can be dry distilled and thermally decomposed in the coke oven up to a maximum of 26 wt % of the charged coal. As the specific gravity of coal is about twice that of plastic, even if 34 chambers (34%) of a coke oven having 100 chambers are defined as chambers exclusively for thermal decomposition of chlorine-containing plastics and the remaining 66 chambers (66%) are used as coal dry distillation chambers, it is theoretically possible to supply enough ammonia for conversion of all chlorine discharged from the chlorine-containing waste plastics to ammonium chloride. Actually, taking reaction efficiency into account, in a coke oven having 100 coke oven chambers, up to a limit of 5 chambers (5%) to 10 chambers (10%) should preferably be designated as coke oven chambers exclusively for thermal decomposition of chlorine-containing plastics.

The method explained in the following can be adopted for measuring the chlorine content of waste plastics. Repeatedly apply the quartering method to 10 kg of waste plastics comminuted to 10–20 mm until finally subdividing to typical samples of 20 g each. Freeze-crush the samples into powder. As the qualitative analysis method, use X-ray fluorescence analysis to obtain percent-order analysis results for the powders. As the quantitative analysis method, use ion chromatography to measure the Cl ion quantity of the chlorides obtained in accordance with the Testing Method for Cl by the Bomb Combustion Method of JIS K 2541 "Testing Method for Sulfur Component of Petroleum and Petroleum Products" and convert to total Cl amounts. Based on the results, define the chlorine content as the average value.

In this invention, when the chlorine-containing waste plastics are thermally decomposed together with coal in the same coke oven chamber, the percentage of the total amount of charged raw material accounted for by the chlorine-containing waste plastics differs between the case of charging the chlorine-containing waste plastics after blending them with the raw material coal beforehand and the case of not blending them beforehand.

Although, as pointed out earlier, chlorine-containing waste plastics classified/recovered from general households contains 5–10 wt % of chlorine, it has a chlorine content of approximately 2% after passing through ensuing winnowing and other waste plastic dry sorting. In this case, since about 150 mol of ammonia is generated per ton of coal (about 200 mol per ton of coke), even if chlorine-containing waste plastics are added at 226 kg per ton of coal (=150×35.4 (molecular weight of chlorine)/0.02/1000), i.e., up to a maximum of 26 wt % relative to charged coal, the chlorine-type gases generated thereby can be captured as ammonium chloride.

When wet sorting is adopted as a method of sorting the aforesaid classified/recovered chlorine-containing waste plastics, the chlorine content of the waste plastics can be made lower and a larger amount of chlorine-containing plastics can be processed than in the case of winnowing and other dry sorting but, conversely, the yield of the plastic sorting decreases.

The coal charged together with the chlorine-containing plastics need only be one that generates coke-oven gas containing ammonia and water. Selection of type of coal as in an ordinary coking operation is unnecessary.

In the present invention, when chlorine-containing plastics are not blended with coal and the chlorine-containing plastics are thermally decomposed after charging, the percentage of total charged raw material accounted for by the chlorine-containing waste plastics is set in the range of 0.05–26 wt %.

If the percentage of total charged raw material accounted for by chlorine-containing waste plastics exceeds 26 wt %, the amount of raw material coal is insufficient for supplying the amount of ammonia needed to capture the chlorine-type gases generated from the chlorine-containing plastics in the ammonia liquor as ammonium chloride. The upper limit thereof is therefore set at 26 wt %. If the percentage of chlorine-containing waste plastics becomes less than 0.05 wt %, the practical merit as a process for recycling waste plastics with a coke oven is lost.

In the present invention, when chlorine-containing waste plastics are blended with coal beforehand and the chlorine-containing plastics are thermally decomposed after charging, the percentage of total charged raw material accounted for by the chlorine-containing waste plastics is set in the range of 0.05–1 wt %. When the percentage of chlorine-containing waste plastics is less than 0.5 wt %, the practical merit as a process for recycling waste plastics is too small. When it exceeds 1 wt %, the coke strength sharply decreases.

Figure 3:
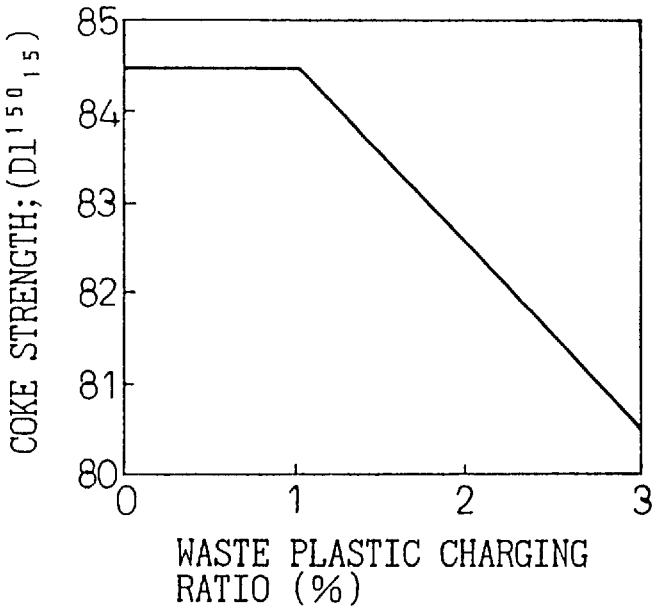
FIG. 3 is a diagram showing relationship between amount of added waste plastics and coke strength.

FIG. 3 is shows the relationship between amount of added waste plastics and coke strength.

A method for recycling chlorine-containing waste plastics having a high polyvinyl chloride content will be explained next. When chlorine-containing waste plastics composed 50% of polyvinyl chloride are charged/dry distilled in the coke oven at the rate of 1 wt % relative to the amount of charged coal, 80 mol (=1000000×0.01×0.5×0.57/35.4) of hydrogen chloride gas is generated per ton of coal (molecular weight of chlorine: 35.4, chlorine content of polyvinyl chloride: apprx. 57%). On the other hand, about 150 mol of ammonia is generated from one ton of coal, so that when 1 wt % of waste plastics is added relative to charged coal in the present invention, sufficient ammonia gas for capturing the hydrogen chloride gas generated from the waste plastics by coal dry distillation as ammonium chloride can be constantly supplied even if the waste plastics consist 50% of polyvinyl chloride. Moreover, in addition to the ammonium generated by dry distillation of the raw material coal, aqueous ammonium solution obtained by earlier dry distillation of raw material coal is stored and circulated for use as ammonia liquor to be sprayed at the bend sections of the ascension pipes of the coke oven in order to capture chlorine-type gases as ammonium chloride. When this is also taken into consideration, it can be seen that sufficient ammonia (ammonia liquor) is present for capturing the chlorine-type gases generated from the waste plastics.

In the present invention, in order to secure sufficient ammonia for capturing the chlorine-type gases generated from the waste plastics as ammonium chloride, an amount of coal is used that generates ammonia at 1.1 to 2 times the molar amount of chlorine in the generated chlorine-type gases.

Although it is also possible to set the lower limit of the amount of ammonia generated by the coal at 1.0 times the molar amount of chlorine generated by the waste plastics, it is preferably set at 1.1 times in order to thoroughly capture the chlorine component as ammonium chloride.

When the amount of ammonia exceeds 2 times the molar amount of chlorine in the generated chlorine-type gases, a large amount of coal is needed to process the waste plastics and the size of the coke oven must be increased. Since this is economically inefficient, the upper limit is set at 2 times the molar amount of chlorine in the chlorine-type gases. The amount of coal needed to process one ton of chlorine-containing waste plastics with a chlorine content of 2 wt % is 4.1 t to 7.5 t.

The amount of waste plastics added relative to the coal is regulated by the following method. After the waste plastics have been placed in the waste plastic hopper, a feeder is used to regulate the amount of waste plastics dispensed from the hopper per unit time, thereby regulating the amount added to the coal.

As was pointed out earlier, when the chlorine-containing plastics are blended with the raw material coal in advance of charging into the coke oven, no problem arises regarding coke quality degradation in cases where the amount of charged waste plastics is not greater than 1 wt % of the raw material coal. The composition and grade of the blending coal used as the raw material coal can therefore be the same as in an ordinary coking operation in which chlorine-containing waste plastics are not added.

When the raw material coke and the waste plastics are blended in advance of being charged into the coke oven and dry distilled, if the amount of charged waste plastics exceeds 1 wt % of the raw material coal, the coke quality is degraded. The grade of coal blended as the raw material coal in this case is therefore preferably selected so as to compensate for the decrease in coke strength owing to the charging of waste plastics.

In the case where the raw material coal and the waste plastics are charged into the coke oven and dry distilled without being blended in advance, however, degradation of coke quality can be avoided even if the amount of charged waste plastics exceeds 1 wt % of the raw material coal. The raw material coal therefore need not be specially selected as a grade of blending coal to compensate for decline in coal strength by waste plastic charging.

Coal can generally be classified into coking coal suitable for production of blast furnace coke and noncoking coal not appropriate for this purpose. In actual coke oven operation, coking coal and noncoking coal are used at an arbitrary blending ratio to obtain the desired coke quality.

Noncoking coal as termed here is generally coal having a maximum fluidity index of 10 ddpm as determined by a fluidity test conducted by the Gieseler plastometer method prescribed by JIS M 8801 or having a vitrinite mean reflectance of not greater than 0.8.

In a case where the amount of charged waste plastics exceeds 1 wt % or the raw material coal, adequate coke strength compensation can be achieved by reducing the blending ratio of the noncoking coal and increasing the blending ratio of the coking coal in proportion to the decrease in coke strength caused by waste plastic charging.

As coking coals usable for strength compensation can be adopted, for example, Goonyella coal, North Goonyella coal, Saraji coal, Blue Creek coal, Luscar coal, Riverside coal, Elkview coal, Line Creek coal and the like.

The temperature in the case of dry distillating waste plastics in a coke oven chamber can be the same as in ordinary coke oven operation. The optimum temperature when dry distillating coal in a coke oven is ordinarily 1300° C. This is because polyvinyl chloride, polyvinylidene chloride and the like usually undergo thermal decomposition at around 250° C., gasify at about 400° C. and totally decompose at 1300° C. In the case of thermally decomposing or dry distillating chlorine-containing waste plastics together with raw material coke in a coke oven chamber, therefore, the dry distillation temperature and dry distillation pattern can be can be implemented under the operating conditions during ordinary coal dry distillation.

Methods available for capturing the chlorine-type gases generated by thermal decomposition of waste plastics as ammonium chloride include, in addition to using ammonia liquor (ammonia and water generated by coal dry distillation) circulated for use in the coke oven as described in the foregoing, that of using a gas or aqueous solution containing ammonia produced by another method in an amount chemically equivalent to the chlorine and bringing it into contact with the chlorine. However, the sublimation point of ammonium chloride is 337.8° C. and a high temperature state exits after thermal decomposition of the waste plastics in the coke oven or the thermal decomposition furnace. Mere production of ammonium chloride by contacting the chlorine-type gases with ammonia is therefore not enough and it is further necessary to cool the ammonium chloride to keep it from sublimating. Use of aqueous ammonia solution is therefore particularly preferable.

When ammonia gas or aqueous ammonia is used to capture the chlorine-type gases generated by thermal decomposition of the waste plastics as ammonium chloride, the high processing cost makes it preferable to use, for example, the aqueous ammonia (ammonia liquor) generated during coal dry distillation in a coke oven or the like. The ammonium chloride generated by contact between the chlorine-type gases generated by the waste plastics and ammonia is soluble in water. Therefore, by dissolving it in water and, after discharge to the exterior of the coke oven or thermal decomposition furnace, further adding a strong base to convert the ammonium chloride to a strong basic salt and ammonia and make the chlorine component harmless, the problems of corrosion of the processing equipment by chlorine-type gases, clogging of pipes by adhesion of ammonium chloride to their inner surfaces and the like can be prevented.

When coal is dry distilled in a coke oven, the ammonia necessary for making the chlorine-type gases generated by the waste plastics harmless is generated by the coal. The temperature in the space at the top of the coke oven chamber is about 800° C. and the hydrogen chloride gas and other chlorine-type gases generated by the waste plastics and the ammonia gas pass through the oven-top space and then through the ascension pipes provided above the coke oven chambers to bend sections of the ascension pipes. The gas temperature at the ascension pipe sections is about 700° C. As the ammonia and chlorine-type gases undergo ammonia liquor flushing and are cooled at the ascension pipe bend sections, the chlorine-type gases and the ammonia are incorporated in the ammonia liquor as ammonium chloride.

The flushing ammonia liquor is circulated and used commonly for all coke oven chambers of the coke oven.

The method conventionally used in coke ovens (see 7 in FIG. 2) can be adopted as the flushing method. Although cast iron is generally used as the material of the ascension pipes, the pipe material specifications up to the dry main where ammonia gas is water-sprayed (flushing) can, depending on the circumstances, be altered taking corrosion into account.

In the present invention, the waste plastics can be thermally decomposed using a thermal decomposition furnace instead of a coke oven. This can be achieved by installing a unit for contacting the thermal decomposition gas discharged from the thermal decomposition furnace and the ammonia-containing gas and a unit for adding a strong base to the water containing the ammonium chloride alongside the thermal decomposition furnace.

For example, the method can be adopted of installing the thermal decomposition furnace alongside the coke oven and leading the thermal decomposition gas containing chlorine-type gases after thermal decomposition of the waste plastics in the thermal decomposition furnace to the ascension pipe sections of the coke oven.

Figure 2:
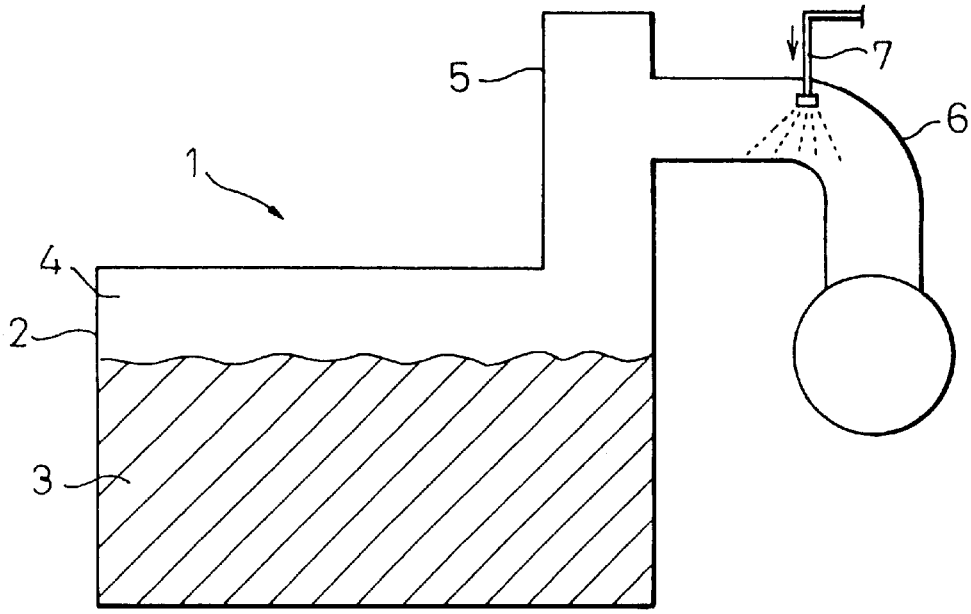
FIG. 2 is a schematic sectional view showing a state inside a coke oven of the present invention.

Next, a strong base, e.g., sodium hydroxide (caustic soda 16) is added to the ammonia liquor or aqueous ammonia containing ammonium chloride extracted to the exterior of the coke oven or thermal decomposition furnace system (see 16 in FIG. 1). By this, the ammonium chloride in the ammonia liquor or aqueous ammonia reacts with the sodium hydroxide to become sodium chloride and ammonia. The amount of sodium hydroxide added is preferably the chemical equivalent of the ammonium chloride or a slightly larger amount. Some other strong base such as potassium hydroxide can be adopted in place of sodium hydroxide.

Figure 12:
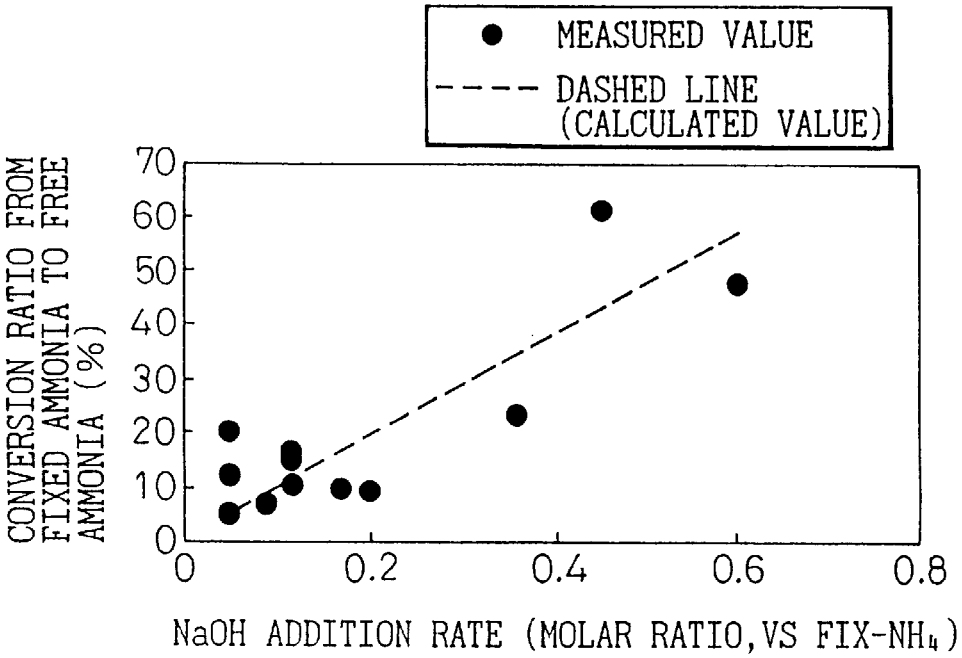
FIG. 12 is a diagram showing relationship between caustic soda addition rate and conversion rate of fixed ammonia to free ammonia.

The nitrogen content of the ammonia liquor is controlled by the following method. Ammonium chloride in the ammonia liquor is converted to ammonia and sodium chloride by adding caustic soda to the ammonia liquor, whereafter nitrogen is removed from the ammonia liquor by vaporizing and removing ammonia in an ammonia remover. The rate of caustic soda addition (mol ratio) necessary for the ammonium chloride concentration of the ammonia liquor is calculated beforehand, as shown by the example of FIG. 12, and caustic soda is added based on the measured value of the ammonium chloride concentration of the ammonia liquor and the calculated caustic soda addition rate. As an everyday control method, the total nitrogen content before and after caustic soda addition was measured several times a day and operation was conducted while confirming that the total nitrogen content stayed at or below a reference value.

Figure 13:
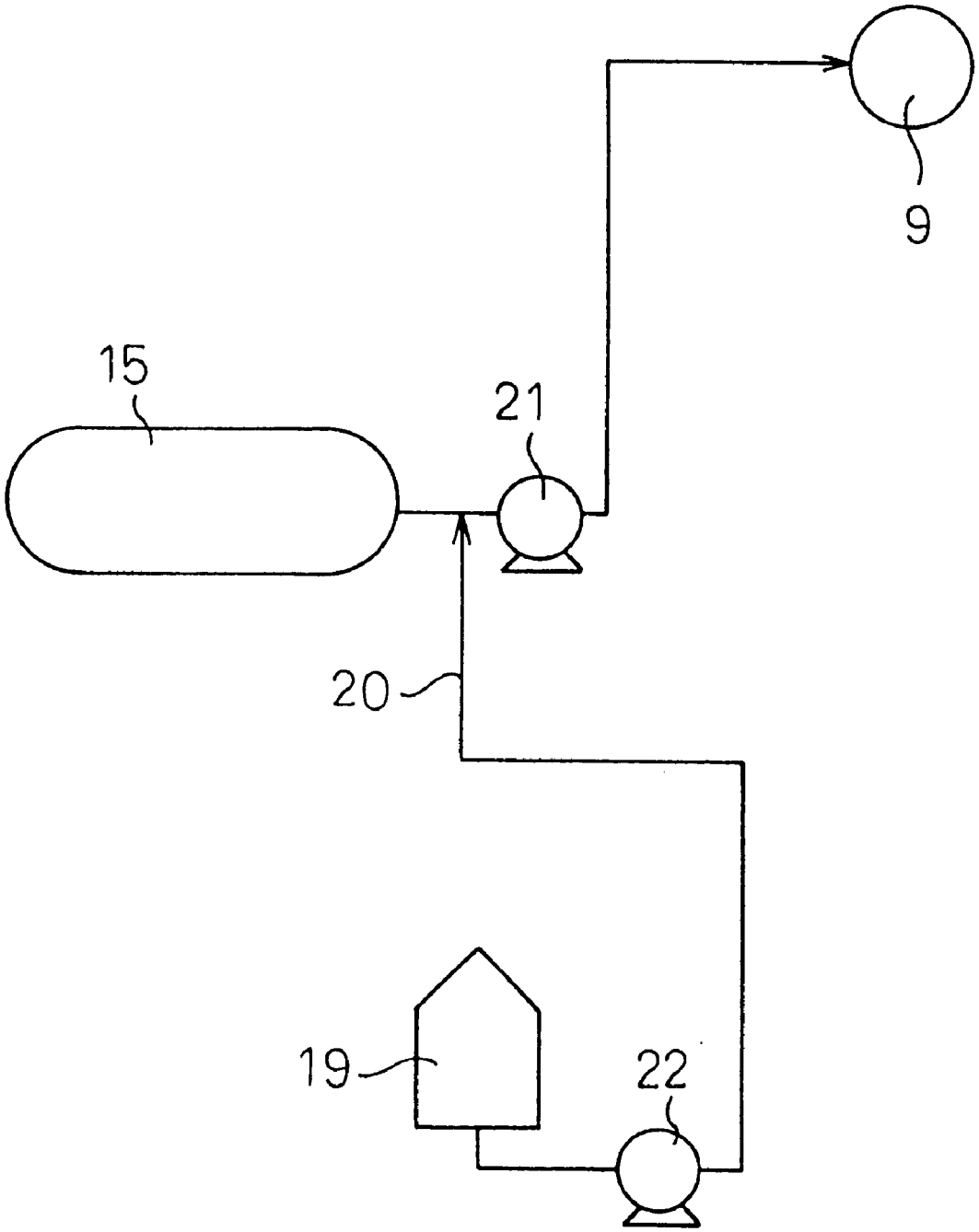
FIG. 13 is a diagram showing a caustic soda addition point.

As shown in FIG. 13, in order to promote reaction by thorough mixing of the caustic soda, the caustic soda was added through a pipe 20 connected to the suction side of an ammonia liquor payout pump 21 installed on the outlet side of a source ammonia liquor tank 15.

Owing to the addition of the caustic soda or other strong base to the ammonia liquor or aqueous ammonia, the ammonium chloride becomes sodium chloride and ammonia (see 17 in FIG. 1). In addition, the ammonia 17 is separated and recovered in an ammonia remover 9 and put to effective use, while the remainder is discharged into seawater after being subjected to activated sludge treatment. The ammonia remover can be one of a conventional type such as the vapor stripping type.

Measurement of the total nitrogen concentration of the effluent was conducted in accordance with the summing method described in JIS K 0102 and ultraviolet absorptiometry. In the summing method, the sample is added with sodium hydroxide and distilled, ammonia produced by decomposition of ammonia ions and some of the organic nitrogen compounds are removed, Devarda's alloy is added to reduce nitrous acid ions and nitric acid ions to ammonia, the ammonia is separated by distillation, and the amount of nitrogen is determined by indophenol blue absorptiometry. Separately, a sample is added with copper sulfate, potassium sulfate and sulfuric acid and heated to effect decomposition and change organic nitrogen compounds into ammonium ions, followed by distillation as alkaline to distill and separate ammonium ions contained in the sample together therewith, and determination of nitrogen amount by indophenol blue absorptiometry. The method calculates total nitrogen concentration by combining this amount with a nitrogen amount corresponding to the nitrous acid ions and nitric acid ions found earlier.

In ultraviolet absorptiometry, total nitrogen amount is analyzed by the following method. The sample is added with alkaline solution of potassium peroxodisulfate and heated to about 120° C. to convert nitrogen compounds to nitric acid ions and decompose organic substances. After the pH of this solution has been adjusted to 2–3, determination is effected by absorptiometric measurement of 220 nm wavelength of the nitric acid ions. Since the organic substances in the sample are readily decomposed and the quantity is small, this method is simpler than the foregoing summing method.

It is also effective to adjust the amount of added caustic soda according to periodic fluctuations in the so-measured effluent nitrogen concentration.

The tar component contained in the ammonia liquor after flushing is separated from the water component by decantation (see 8 in FIG. 1). As the tar component after separation includes around 2–3% of residual ammonia liquor, it includes ammonium chloride, but normally at a level that is not a problem. When the amount of waste plastics treated is great and the chlorine component concentration of the tar exceeds the allowable level, however, the chlorine component concentration of the tar is preferably further dewatered using a centrifuge or the like to maintain the same level as when waste plastics are not added.

After the waste plastics have been dry distilled and thermally decomposed in the coke oven, the coke removal operation, the coke-oven gas and tar recovery, and the use thereof can be conducted as in the conventional coke oven operation.

EXAMPLES

Waste plastics containing chlorine-system resins were comminuted to about 10 mm and volume-reduced using a screw kneader. The volume-reduction temperature was about 120° C. owing to screw friction heating. What was obtained by cutting these to a diameter of about 10 mm and air-cooling them on a conveyor belt was mixed in advance with coal at the blending ratios shown in FIG. 5 and charged into the coke oven chambers of a coke oven battery having 100 coke oven chambers. Charging into the coke oven was from the top of the coke oven by the same method as for conventional coal charging. The dry distillation pattern adopted was the same as that for conventional coke production. The total dry distillation time was 20 hr.

In Examples 6–9, the percentage of coking coal contained in the blended coal was increased over that in Examples 1–5 in order to maintain the coke strength. In Example 9, dry distillation was conducted with only waste plastics charged into 5 of the 100 coke oven chambers and the same blended coal as in Examples 1–3 charged into the remaining 95 chambers.

The strength of the coke forced out of the coke oven chambers after dry distillation was evaluated as ○ when the drum strength of the coke determined in conformity with JIS K 2151 (+15 mm after 150 revolutions) was 84 or greater and was evaluated as X when less than 84. The chlorine concentration of the light oil was evaluated as ○ when 10 ppm or less and as X when greater than 10 ppm. The capture ratio by flushing was evaluated as ○ when 90% or greater and as X when less than 90%. The waste water removed of ammonia by addition of caustic soda and vapor stripping was diluted 40 fold and an evaluation of ○ was made when the nitrogen concentration of the diluted effluent was 20 mg/l or less and an evaluation of X was made when it was greater than 20 mg/l.

Figure 14:
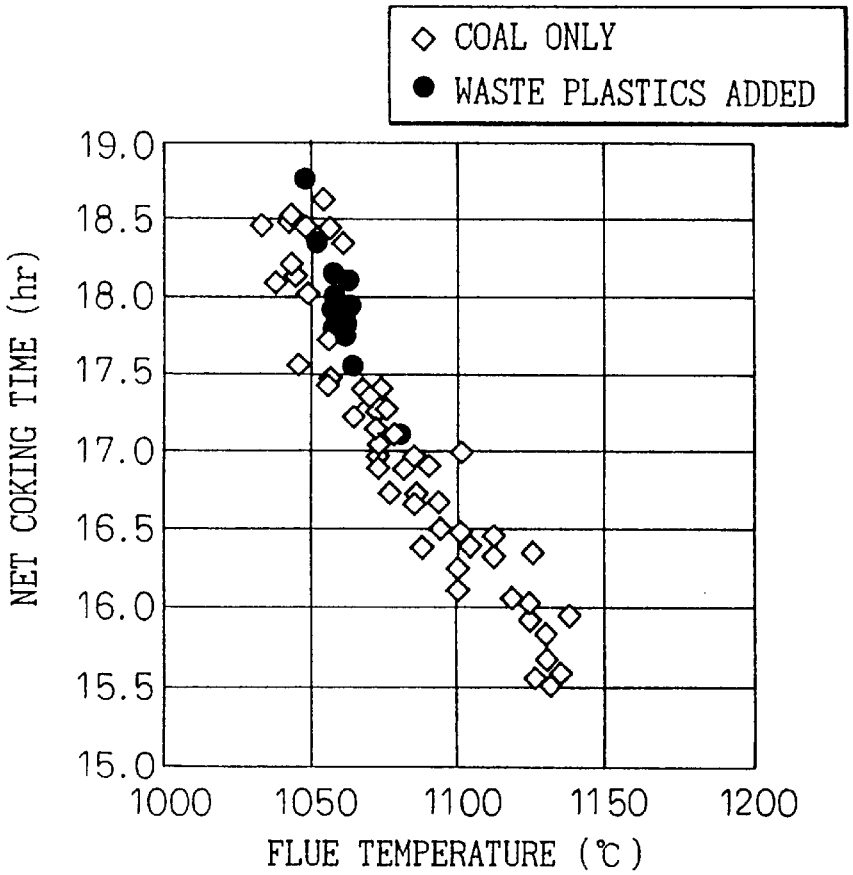
FIG. 14 is a diagram showing effect of waste plastic addition/nonaddition on coke productivity.

In Examples 1–8, the effect of waste plastic addition on coke oven operation was evaluated. FIG. 14 is shows the effect on coke productivity. The coking time with 1–2 wt % addition of waste plastics was substantially the same as in the case of coal only and the addition of waste plastics had substantially no effect on dry distillation time or productivity. As the bulk density of the waste plastics was small, however, when they were added to the coal, the bulk density decreased at the time of charging into the coke oven. Moreover, since the addition of waste plastics lowered the amount of charged raw material coal, the coke productivity declined, but the effect thereof was slight.

Figure 15:
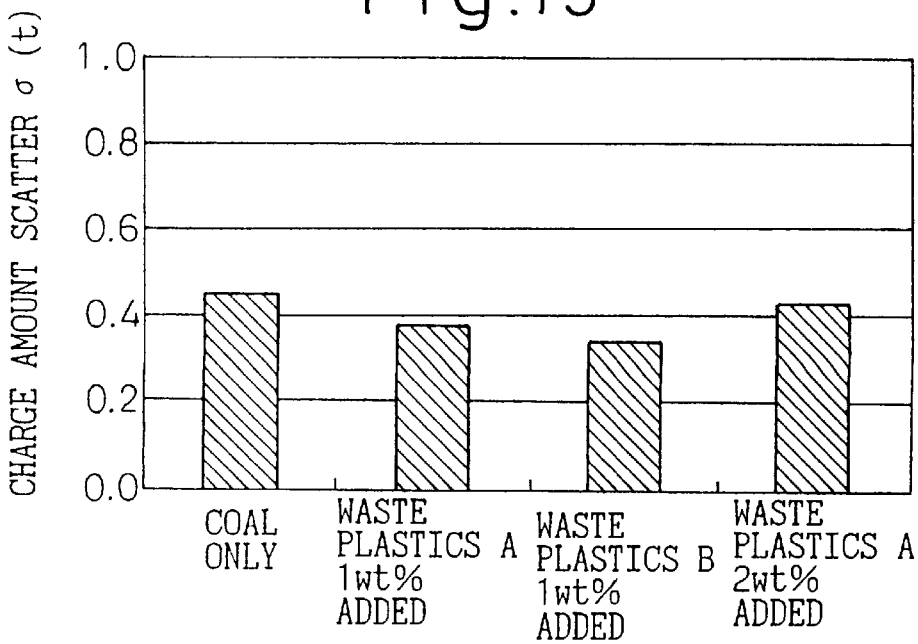
FIG. 15 is a diagram showing a comparison of charged coal amount scatter with and without waste plastic addition.

FIG. 15 shows the charged coal amount scatter when waste plastics were added. Addition of waste plastics caused no increase in charged coal amount scatter and did not affect the charging operation.

Figure 16:
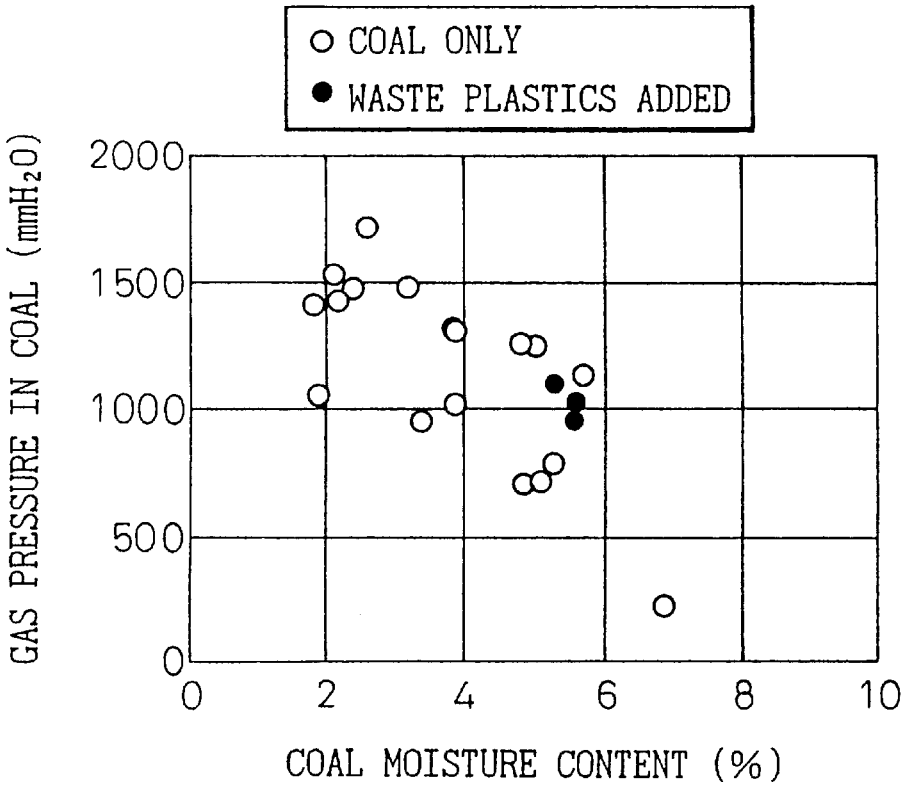
FIG. 16 is a diagram showing a comparison of gas pressure in coal with and without waste plastic addition.

FIG. 16 shows gas pressure in the coal when waste plastics were added. No change in coal internal gas pressure owing to waste plastic addition was observed.

Figure 17:
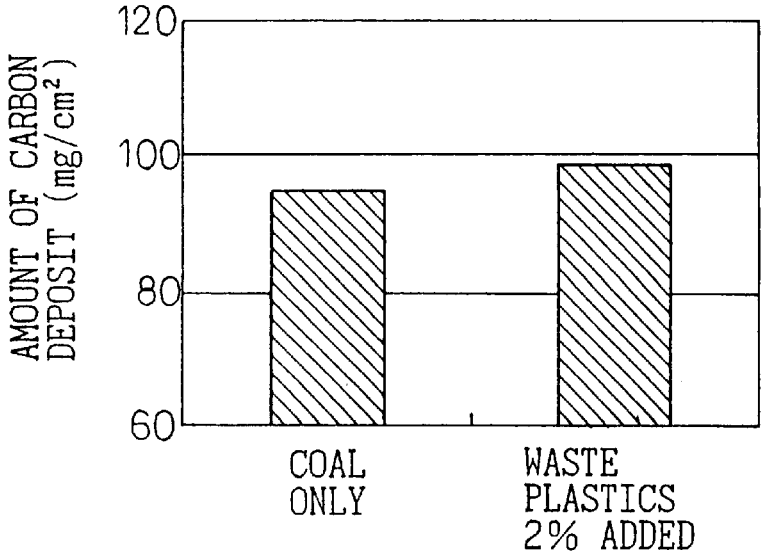
FIG. 17 is a diagram showing a comparison of amount of carbon deposit to the top portion of a coke oven chamber with and without waste plastic addition.

FIG. 17 shows carbon adhesion when waste plastics were added. No increase in amount of adhering carbon owing to waste plastics addition was observed.

This invention uses the ammonia gas contained in the coal gas etc. generated during dry distillation of coal to convert to ammonium chloride the hydrogen chloride and other chlorine-type gases generated by thermal decomposition of

TABLE 5

| | | Amount of waste plastics charged (wt %/t-coal) | Waste plastic chlorine content (wt %) | Coke strength evaluation | Light oil chlorine content evaluation | Tar chlorine content evaluation | Chlorine capture evaluation | Nitrogen evaluation of waste water |
|---|---|---|---|---|---|---|---|---|
| 1 | Comparative example | 0.5 | 0.5 | ○ | ○ | ○ | ○ | ○ |
| 2 | Example 1 | 1.0 | 1.0 | ○ | ○ | ○ | ○ | ○ |
| 3 | Example 2 | 1.0 | 2.0 | ○ | ○ | ○ | ○ | ○ |
| 4 | Example 2 | 1.0 | 2.2 | ○ | ○ | ○ | ○ | ○ |
| 5 | Example 2 | 1.0 | 2.3 | ○ | ○ | ○ | ○ | ○ |
| 6 | Example 2 | 1.0 | 3.0 | ○ | ○ | ○ | ○ | ○ |
| 7 | Example 2 | 1.5 | 2.0 | ○ | ○ | ○ | ○ | ○ |
| 8 | Example 2 | 2.0 | 2.0 | ○ | ○ | ○ | ○ | ○ |
| 9 | Example 2 | 2.0 | 2.3 | ○ | ○ | ○ | ○ | ○ |
| 1 | Example 2 | 5.0 | 2.0 | ○ | ○ | ○ | ○ | ○ |
| 1 | Example 2 | 5.0 | 2.0 | ○ | ○ | ○ | ○ | ○ |

charged raw material including chlorine-containing resin, chlorine-containing organic compound, or waste plastic containing the same, dissolves the generated ammonium chloride in ammonia liquor and, after discharge, decomposes it with sodium hydroxide to remove nitrogen, so that the charged raw material of chlorine-containing resin, chlorine-containing organic compound, or waste plastic containing the same can further be thermally decomposed without increasing the nitrogen content of the discharged ammonia liquor, thereby enabling reuse as gas and reuse as coke raw material.

What is claimed is:

1. A method for processing chlorine-containing resin, chlorine-containing organic compound, or waste plastic containing the same, characterized by thermally decomposing chlorine-containing resin, chlorine-containing organic compound or waste plastic containing the same, contacting generated thermal decomposition gas containing chlorine-type gas with coal gas containing ammonia generated during dry distillation of coal, to take a chlorine component of the thermal decomposition gas into ammonia liquor as ammonium chloride, and adding a strong base to the ammonia liquor to make the chlorine component into a strong basic salt.

2. A method according to claim 1, characterized in that chlorine content of the chlorine-containing resin, chlorine-containing organic compound or waste plastic containing the same is not less than 0.5 wt %.

3. A method according to claim 1 characterized in that the strong base is sodium hydroxide and the strong basic salt is sodium chloride.

4. A method according to claim 1, characterized in that the chlorine-containing resin, chlorine containing organic compound, or waste plastic containing the same is dry distilled in a coke oven.

5. A method according to claim 1, characterized in that the chlorine-containing resin, chlorine-containing organic compound, or waste plastic containing the same is dry distilled together with coal.

6. A method according to claim 1 characterized in that the chlorine-containing resin, chlorine-containing organic compound, or waste plastic containing the same is thermally decomposed in some coke oven chambers of a coke oven having multiple coke oven chambers, generated thermal decomposition gas containing chlorine-type gas is contacted with ammonia liquor circulating through the coke oven, and the chlorine component of the thermal decomposition gas is taken into the ammonia liquor as ammonium chloride.

7. A method according to claim 5, characterized in that the chlorine-containing resin, chlorine-containing organic compound, or waste plastic containing the same is blended with coal at a ratio of not less than 0.05 wt % and not greater than 26 wt % of the coal and dry distilled for thermal decomposition.

8. A method according to claim 5, characterized in that the chlorine-containing resin, chlorine-containing organic compound, or waste plastic containing the same is blended with coal at a ratio of not less than 0.05 wt % and not greater than 1 wt % of the coal and dry distilled to produce coke.

9. A method according to claim 1, wherein an amount of coal is used that discharges ammonia at 1.1 to 2 times the molar amount of chlorine in the generated chlorine type gases.

10. A method according to claim 1, characterized in that the chlorine-containing resin, chlorine-containing organic compound or waste plastic containing the same is heated for volume-reduction and hardened before thermal decomposition.

* * * * *